US005226720A

United States Patent [19]

Caferro

[11] Patent Number: 5,226,720

[45] Date of Patent: Jul. 13, 1993

[54] LOUVER ADAPTER FOR "T" RAIL MOUNTED LIGHT FIXTURES

[75] Inventor: Ronald N. Caferro, Spokane, Wash.

[73] Assignee: Ecolite Manufacturing Company, Inc., Spokane, Wash.

[21] Appl. No.: 820,292

[22] Filed: Jan. 8, 1992

[51] Int. Cl.[5] ..... F24B 1/02

[52] U.S. Cl. ..... 362/150; 362/217; 362/290; 362/408; 52/484; 52/507

[58] Field of Search ..... 362/150, 223, 290, 408, 362/217; 52/484, 507, 633

[56] References Cited

U.S. PATENT DOCUMENTS

| | | | |
|---|---|---|---|
| 1,974,819 | 9/1934 | Koerner | 52/484 |
| 2,284,898 | 6/1942 | Hartman | 52/732 |
| 2,787,813 | 4/1957 | Sylvan | 52/484 |
| 3,055,469 | 9/1962 | Byssing et al. | 52/484 |
| 3,340,662 | 9/1967 | Deinhart et al. | 52/667 |
| 3,356,402 | 12/1967 | Smith | 52/484 |
| 3,973,368 | 8/1976 | Moeller | 52/484 |
| 4,272,804 | 6/1981 | Blum | 362/150 |
| 4,901,485 | 2/1990 | Menchetti et al. | 52/484 |

OTHER PUBLICATIONS

Convertalume Advertisement (Nov. 1990 or earlier) Ecolite Manufacturing Co., Spoikane, Wash., 2 pages.

Aluminum Parabolic Louvers Advertisement (Nov. 1990 or earlier) Ecolite Manufacturing Co., Spokane, Wash., 2 pages.

*Primary Examiner*—Carroll B. Dority

*Attorney, Agent, or Firm*—Wells, St. John, Roberts, Gregory & Matkin

[57] ABSTRACT

An adapter for facilitating mounting of lighting louvers in "T" rail lighting fixtures is provided. The adapter includes an elongated bar including a first flange extending laterally from an upright web portion and a second flange extending in an opposite direction of the first flange from the web. The bar is formed of a relatively flat, thin sheet metal material that is bent into the configuration such that one portion defines the first flange, another portion defines the upright web, and another portion defines the second flange. The first flange is of sufficient dimension to be received between the lighting fixture frame and the "T" rail. The fixture frame therefore secures the bar in place within the fixture opening. The upright web section includes means for receiving and mounting the lighting louver. The second flange functions to overlap a portion of the lighting louver and act as a light screen between the "T" rail and the peripheral edges of the lighting louver.

15 Claims, 2 Drawing Sheets

LOUVER ADAPTER FOR "T" RAIL MOUNTED LIGHT FIXTURES

TECHNICAL FIELD

The present invention relates to adaptation of "T" rail ceiling lighting arrangements for louvers.

BACKGROUND OF THE INVENTION

Many inefficient lighting arrangements are currently in use in which a translucent panel or lighting grid is provided in a "door frame" that is removably attached to a lighting fixture within a "T" rail suspended ceiling system. The lighting panels are undesirable, especially in work areas where computer monitor screens are viewed. The light from such panels causes glare on the monitor screens. It therefore becomes desirable to change the panels to more efficient, low glare producing lighting louvers. Such louvers are specifically designed for particular applications in order to maximize the available amount of light for the area, yet reduce the glare on surfaces such as computer monitor screens.

There is a difficulty in converting between the translucent lighting panels and louvers due to the thickness dimension of the louvers, and the particular manner in which the previous "door frame" and lighting panel were mounted to the light fixture. The obvious solution, custom built louvers with specially adapted door frames is viable but very expensive.

Another solution to this problem has been established by providing a spacer that will fit between the lighting fixture and "T" rail. The spacer frame elevates the lighting fixture and provides a surface against which a lighting louver may be mounted. The difficulty with this arrangement is the vertical clearance required to mount the spacer in position. The fixture must first be lifted and moved away from the lighting opening, and the new unit installed. The fixture is then placed on top of the adapter unit, substantially elevating the top area of the fixture over the spacer and the louver received therein. Many structures do not provide the clearance necessary to allow the lighting fixture to be moved to one side of the lighting opening, or proper overhead clearance for the spacer.

The present invention eliminates the need to substantially elevate or laterally shift lighting fixtures, and will mount to existing "T" rail construction is a simple and quick manner to adapt the "T" rail and fixture to mount a louver type grid.

The present adapter is useful in nearly all existing lighting "T" rail supported fixtures to adapt the lighting openings to receive more desirable lighting louver configurations.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
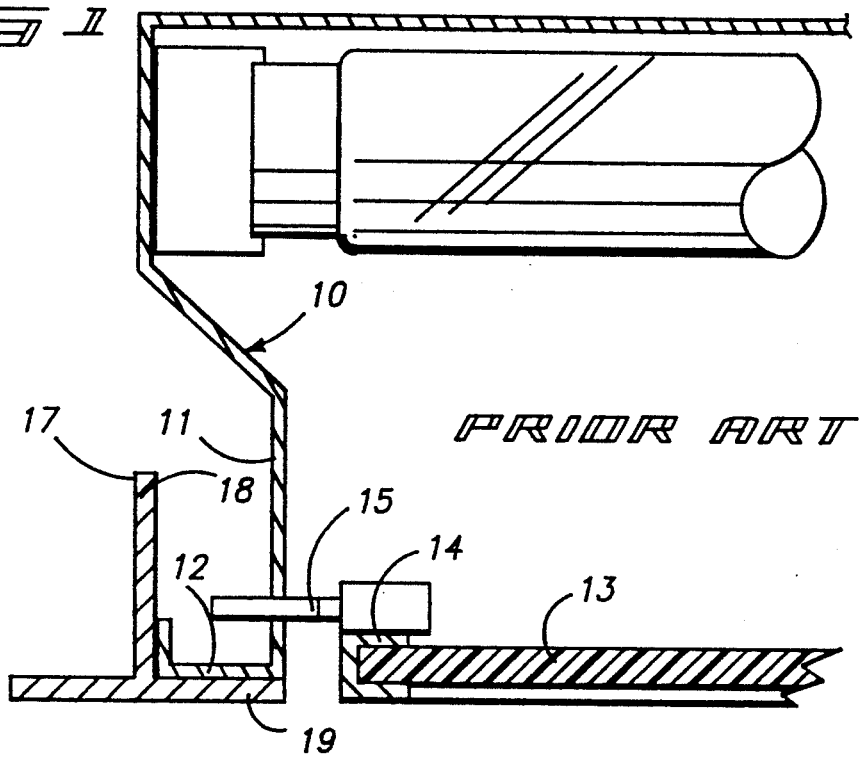
FIG. 1 is an enlarged fragmented view of a "T" rail, lighting fixture, and lighting panel exemplifying a prior art construction.

This disclosure of the invention is submitted in furtherance of the constitutional purposes of the U.S. Patent Laws "to promote the progress of science and useful arts" (Article 1, Section 8).

Before describing the present invention in further detail, a brief description will be given of an exemplary conventional "T" rail and lighting fixture arrangement shown partially in FIG. 1. The lighting fixture is designated with the numeral 10 and includes a rigid peripheral frame 11. The frame includes a bottom end frame foot section 12. A conventional light grid 13 is mounted to the lighting fixture 10 through provision of a peripheral "door frame" 14. The "door frame" may include appropriate mounting pins 15 extending outwardly to be received in appropriate apertures in the "door frame".

The lighting fixture 10 is supported on "T" rails 17. Each "T" rail 17 typically includes a central upright member 18 and opposed horizontal flanges 19. The bottom peripheral foot 12 of the light fixture or 10 typically rests the "T" rail flanges 19. The fixture 10 typically is not fastened in place but may be lifted free of the "T" rail. The fixture frame typically spans a rectangular configuration, matched by a rectangular opening formed by "T" rails suspended from a ceiling (not shown).

Figure 2:
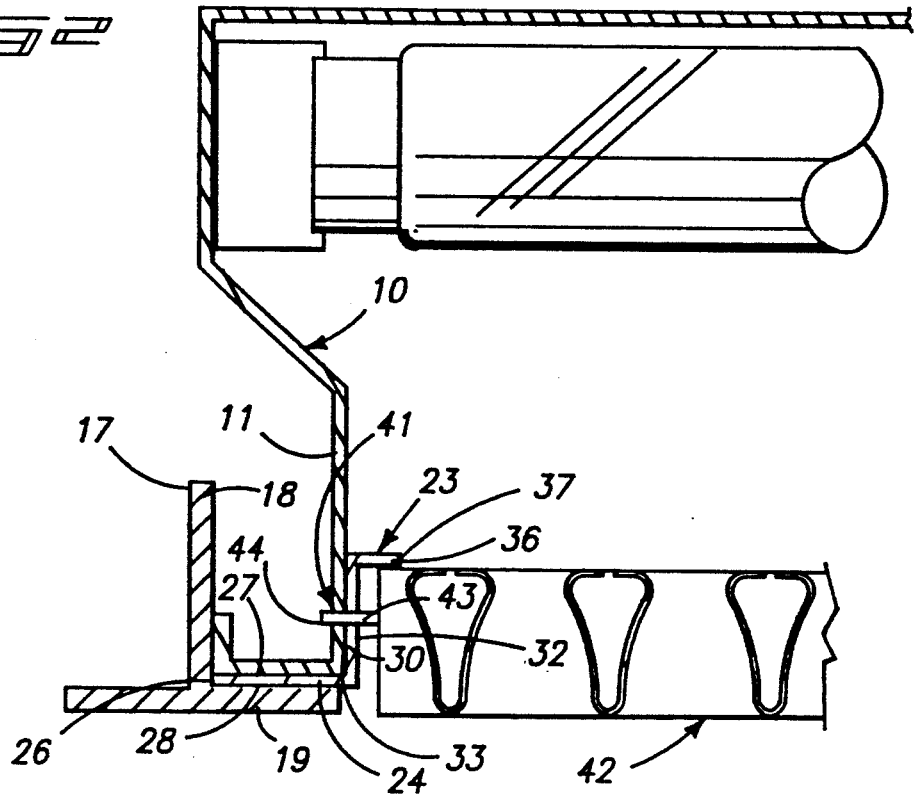
FIG. 2 is a view similar to FIG. 1 only showing positioning of the present adapter and mounting of a lighting louver thereon.

The present invention is useful in adapting the "T" rail and lighting fixture arrangement, without requiring extensive modification, to accept a conventional form of lighting louver 42 (FIG. 2). Such louvers 42 typically are much more efficient in no-glare distribution of light to the area below. Though extremely efficient, such louvers occupy a substantially larger vertical area than the relatively thin flat lighting panels 13. Examples of "T" rails, light, and forms of louver are shown in my prior U.S. Pat. Nos. 5,008,791, dated Apr. 16, 1991, and 4,951,443, dated Aug. 28, 1990 which are hereby incorporated by reference herein.

The present adapter includes an elongated bar 23. A single bar is shown in FIGS. 2–5. However, two identical bars will typically be provided in the same lighting fixture to receive the lower 41 at opposite ends of the "T" rail opening. One end mounting arrangement is shown in FIG. 2, the opposite end would be a mirror image. Thus, two of the bars 23 will face one another across the length of the opening, each receiving and mounting an end of a louver 41 as shown in FIG. 2.

Each bar 23 is preferably formed of flat metal sheet stock and is stamped and bent to include a first flange 24 extending along the length of the bar between opposed ends 25, and a web portion 30. The flange 24 extends laterally to an outward longitudinal edge 26, adapted to abut the upright flange 18 of the "T" rail. The width dimension between the edge 26 and web 30 is advantageously at least equal to the corresponding dimension of the engaged part of the peripheral foot 12 (FIG. 2).

The edge 26 is situated between a top flange surface 27 and an opposed bottom surface 28. The bottom flange surface 28 is adapted to rest on the top surface of the "T" rail horizontal flange 19, while the top flange surface 27 is provided to receive and support the bottom foot 12 of the lighting fixture frame 11. This relationship is clearly shown in FIG. 2.

The bars 23 each include the web portion 30 that is preferably integral with the first flange 24. The web 30 is preferably substantially perpendicular to the first flange 24 and extends upwardly thereof. The web 30 is exposed outwardly of the first flange portion when the bar is positioned in an operative condition between the foot 12 and "T" rail flange 19. Each web 30 includes an inward facing surface 33 and an outward facing surface 32. In use, the inward surface is spaced clear of the fixture frame 11 and the outer surface is adjacent the outward edge of the "T" rail flange 19.

Web 30 leads upwardly to a second flange 36. Second flange 36 extends in a direction opposite to the first flange 24 and is substantially parallel thereto. The second flange 36 extends to a longitudinal edge 37 that projects from the web 30 by a distance substantially less than the distance between the web 30 and the first flange edge 26. Second flange 36 extends longitudinally between opposed ends 38 that are substantially aligned with ends 31 of the web. Thus, ends 25 of the first flange portion 24 extend beyond the web and second flange ends 31, 38.

When installed, the second flange portion 36 functions to provide a light shield or barrier over the gap between the louver and "T" rail, and, in addition, provides additional structural reinforcement against bending.

Figure 3:
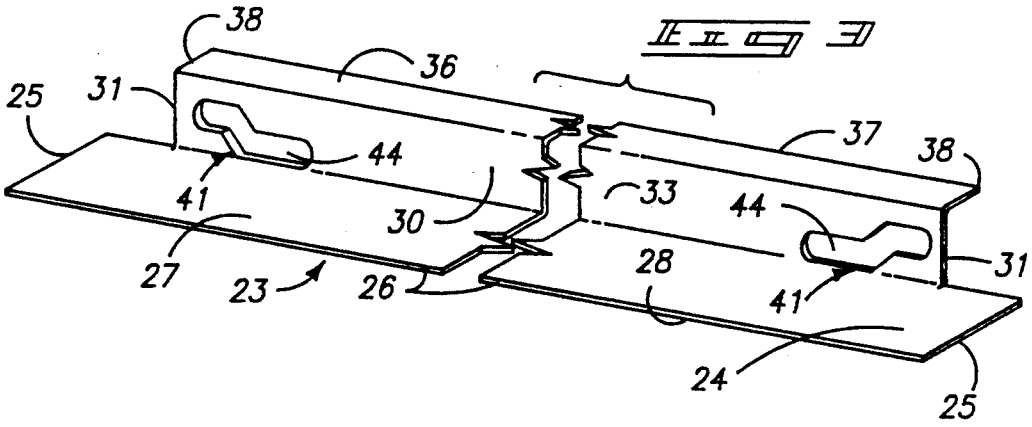
FIG. 3 is a fragmented pictorial view of a bar incorporating features of the present invention.
Figure 4:
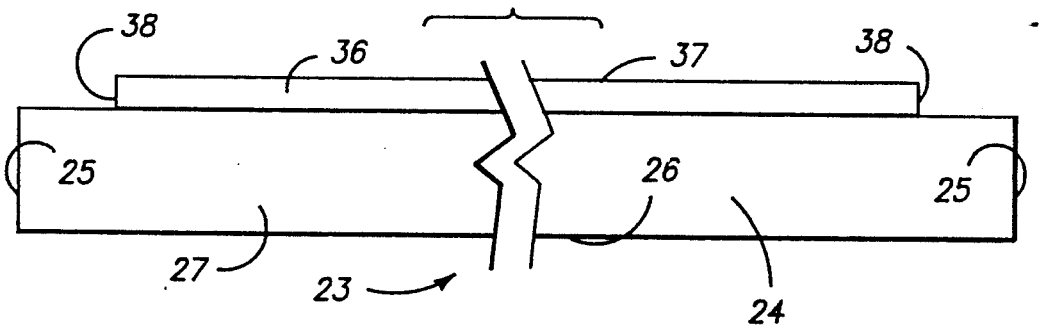
FIG. 4 is a top plan view of the bar.
Figure 5:
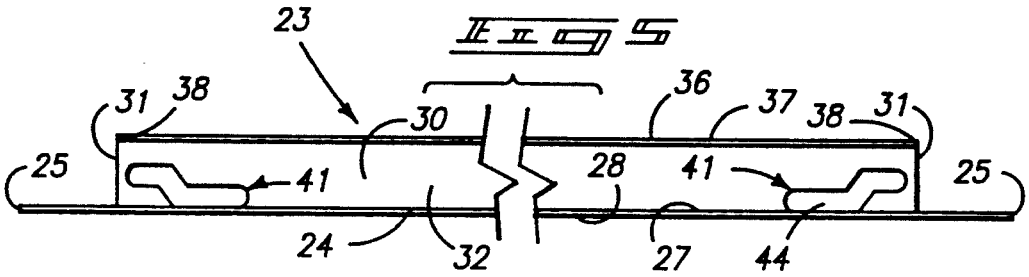
FIG. 5 is a front elevation view of the bar.

The difference in dimension along the length of the bar between the first flange ends 25 and the web and second flange ends 31, 38, is shown in FIGS. 3–5. This distance permits the first flange portion 24 to extend in an overlapping relationship into corner sections of the conventional "T" rail opening with the web 30 and second flange portion 36 clear of the adjacent fixture frame. This maximizes the contact with the "T" rail and fixture frame and the overall support provided to the louver.

A mounting means is indicated at 41 along the bar 23 for receiving and mounting a lighting louver 42 to the web portion 30. The mounting means 41 is, in a first preferred form, comprised of a slot 44 formed adjacent one of the bar ends. The slot 44 may be provided in both ends of the web to facilitate adaptation of different louver configurations. The configuration of the slot is made to readily accept a mounting pin 43 of the louver. Other configurations for mounting a louver may also be provided on the bars 23.

Provision of the mounting means 41 along the web 30 facilitates mounting of the louver to the "T" rail lighting arrangement without the requirement of custom "door frames" or lighting fixtures as was previously required in the past. Furthermore, the low profile configuration of the bar facilitates adaptation of louvers in areas which would otherwise not permit mounting due to overhead space restrictions.

The bar therefore provides secure mounting for the louver, while eliminating the need for alteration of the "T" rail and light fixture arrangement as may be understood by comparing FIGS. 1 and 2. Very little elevational difference is observed between the "T" rail and light fixture due to the thin dimension of the first flange 24. The louvers therefore fit the "T" rails without the appearance of alteration.

In operation, the present adapter may be mounted in a simple and efficient manner. Firstly, the original lighting grid and "door frame" are removed from the lighting fixture and discarded. Then, one end of the lighting fixture is slightly elevated and a bar 23 is inserted with the first flange positioned between the fixture foot 12 and the top surface of the "T" rail horizontal flange 19. The edge 26 is moved into abutment with the upright flange 18 of the "T" rail to secure the bar against undesired lateral sliding movement on the supporting "T" rail flange 19. The fixture is then allowed to rest against the top surface of the flange, thereby securely holding the bar in place.

This procedure is repeated for the opposite end of the fixture. A second bar 23 identical bar is mounted in opposition across the opening from the first installed bar 23. Thus two bars 23 are mounted at opposite ends of the lighting fixture opening, with both bars being held securely in place between the fixture frame and "T" rail flanges.

This is all that is required to adapt the fixture and "T" rail to receive any one of a selected number of louvers 42.

The louver 42 is mounted in the conventional manner, usually with a pin 43 being secured through the mounting means or open slots 44 in the bars 23. The louver is now mounted and functional.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A louver adapter for "T" rail mounted lighting fixtures, comprising:

an elongated bar including a first flange portion extending between flange ends, and an interconnecting web portion extending between web portion ends and oriented angularly in relation to the first flange portion;

a second flange on the bar extending from the web portion to a side thereof opposite that of the first flange by a distance less than that of the first flange;

wherein the first flange portion is substantially planar, and extends to one side of the interconnecting web portion;

wherein the first flange and the web portions extend longitudinally to respective ends and wherein the ends of the first flange extend beyond the ends of the web portion;

wherein the web portion includes louver mounting means thereon adapted to receive and mount a lighting louver.

2. A louver adapter for "T" rail mounted lighting fixtures, as claimed by claim 1 wherein the web portion is substantially perpendicular to the first flange portion.

3. A louver adapter for "T" rail mounted lighting fixtures, as claimed by claim 1 wherein the louver mounting means is comprised of a slot formed through the web portion.

4. A louver adapter for "T" rail mounted lighting fixtures, comprising:

an elongated bar including a first flange portion extending between first flange portion ends, an interconnecting web portion extending along the bar between ends and oriented angularly in relation to the first flange portion, and a second flange portion extending along the bar between ends;

wherein the distance between the ends of the first flange is greater than the distance between the ends of the second flange and the ends of the web portion;

wherein the first flange portion is substantially planar, and extends to one side of the interconnecting web portion;

wherein the second flange portion extends laterally to one side of the interconnecting web portion opposite the first flange portion by a distance less than the lateral distance extended by the first flange; and wherein the web portion includes louver mounting means thereon adapted to receive and mount a lighting louver.

5. A louver adapter for "T" rail mounted lighting fixtures, as claimed by claim 4 wherein the mounting means is situated adjacent one of the ends of the web portion.

6. A louver adapter for "T" rail mounted lighting fixtures, as claimed by claim 4 wherein the mounting means is comprised of a slot formed in the web portion.

7. A louver adapter for "T" rail mounted lighting fixtures, as claimed by claim 4 wherein the mounting means is comprised of a slot formed in the web portion adjacent one of the ends thereof.

8. A louver adapter for "T" rail mounted lighting fixtures, as claimed by claim 4 wherein the first and second flanges are substantially perpendicular to the web portion.

9. A louver adapter for mounting a louver in a suspended ceiling system, the suspended ceiling system having a plurality of longitudinal "T" rails and at least one lighting fixture, wherein the "T" rails have horizontal flanges and the lighting fixture has a frame which is supported by at least one of such horizontal flanges, the louver adapter comprising:

an elongated web portion;

a first flange extending horizontally from the web portion, the first flange being substantially planar to be installed between said "T" rail horizontal flange and said lighting fixture frame, the lighting fixture frame resting against the installed first flange to hold the louver adapter in place against the "T" rail horizontal flange; and mounting means on the web portion for receiving and mounting a lighting louver.

10. A louver adapter as claimed by claim 9 wherein the louver mounting means is comprised of a slot formed through the web portion.

11. A louver adapter as claimed by claim 9 further comprising a second flange extending from the web portion to a side thereof opposite that of the first flange.

12. A suspended ceiling lighting fixture and louver assembly, comprising:

at least one longitudinal "T" rail having a horizontal flange with an upper support surface;

a lighting fixture having a frame which is supported by the upper support surface of the "T" rail horizontal flange;

a louver adapter having an elongated web portion and a first flange extending horizontally from the web portion, the first flange being substantially planar to be installed between the "T" rail horizontal flange and the lighting fixture frame, the first flange resting against the upper support surface, and the lighting fixture frame resting against the first flange to hold the louver adapter in place; and mounting means on the web portion for receiving and mounting the lighting louver to the louver adapter.

13. A suspended ceiling lighting fixture and louver assembly as claimed by claim 12 wherein the louver mounting means is comprised of a slot formed through the web portion.

14. A suspended ceiling lighting fixture and louver assembly as claimed by claim 12, further comprising a second flange on the louver adapter, the second flange extending from the web portion to a side thereof opposite that of the first flange.

15. A method of installing a lighting louver in a suspended ceiling system, the suspended ceiling system having a plurality of longitudinal "T" rails and at least one lighting fixture, wherein the "T" rails have horizontal supporting flanges and the lighting fixture has a frame which is supported by such a supporting flange, the method comprising:

raising the lighting fixture frame from its supporting "T" rail flange;

installing a louver adapter between the supporting "T" rail flange and the lighting fixture frame, the louver adapter having a substantially planar flange which extends horizontally to rest against an upper surface of the supporting "T" rail flange when the louver adapter is installed;

lowering the lighting fixture frame over the installed louver adapter so that the lighting fixture frame rests against the first flange to hold the louver adapter in place against the supporting "T" rail flange; and mounting a lighting louver to the louver adapter.

* * * * *